US012163668B2

(12) United States Patent
Cowan

(10) Patent No.: US 12,163,668 B2
(45) Date of Patent: Dec. 10, 2024

(54) APPARATUS FOR REDUCING UNDESIRED CHANGE IN COOKING APPLIANCE CONFIGURATION

(71) Applicant: Midea Group Co., Ltd., Foshan (CN)

(72) Inventor: Richard W. Cowan, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 0 days.

(21) Appl. No.: 17/018,712

(22) Filed: Sep. 11, 2020

(65) Prior Publication Data

US 2022/0082263 A1 Mar. 17, 2022

(51) Int. Cl.
*F24C 3/12* (2006.01)
*F24C 7/08* (2006.01)
*F24C 15/36* (2006.01)

(52) U.S. Cl.
CPC ..... *F24C 3/12* (2013.01)

(58) Field of Classification Search
CPC ..... F24C 3/12
See application file for complete search history.

(56) References Cited

U.S. PATENT DOCUMENTS 976,475 A 11/1910 Livingston
1,536,016 A * 4/1925 Kavanagh ..... F24C 15/36 126/42
1,772,870 A 8/1930 Lindemann
1,922,361 A 8/1933 Freeland
1,931,334 A 10/1933 Teller et al.
2,539,840 A 1/1951 Jones
2,650,586 A 9/1953 Mills
2,667,864 A * 2/1954 Marx ..... F16K 35/10 126/42
2,764,968 A 10/1956 Shuster
2,847,526 A * 8/1958 Pearce ..... B61L 19/14 200/43.21
3,269,211 A * 8/1966 McGarry ..... G05G 1/015 74/504
3,529,584 A * 9/1970 Celaya ..... F24C 3/124 126/39 N
3,586,825 A 6/1971 Hurley
(Continued)

FOREIGN PATENT DOCUMENTS

DE 19805558 A1 8/1999
GB 591079 A * 8/1947 ..... F24C 3/124
JP 2004332361 A * 11/2004

OTHER PUBLICATIONS

Amazon, 4 Pack Kitchen Stove Knob Covers Baby Proofing Oven Gas Stove Knob Protection Locks for Child Safety, Retrieved from https://www.amazon.com/Kitchen-Coveres-Proofing-Protection-Safety/dp/B07C9VDT4P, Retrieved on Mar. 25, 2019.

*Primary Examiner* — Jorge A Pereiro
*Assistant Examiner* — Logan P Jones
(74) *Attorney, Agent, or Firm* — Gray Ice Higdon

(57) ABSTRACT

An apparatus for reducing undesired change in cooking valve configuration. An appliance may include one or more guard members. The one or more guard members may be adjacent one or more control knobs operably connected to one or more valves. The guard member may overlap one or more portions of the outer periphery of the control knob extending from the control panel in a variety of applications.

12 Claims, 6 Drawing Sheets

(56) References Cited

U.S. PATENT DOCUMENTS

| | | | | |
|---|---|---|---|---|
| 3,597,996 | A * | 8/1971 | Gouwens | G05G 1/087 74/553 |
| 4,625,708 | A * | 12/1986 | Beall | F24C 15/36 D7/402 |
| 4,785,198 | A * | 11/1988 | Chin-Hsiang | H01H 19/04 307/154 |
| 5,156,530 | A * | 10/1992 | Rutschle | F04D 25/08 200/333 |
| 6,627,828 | B1 * | 9/2003 | McCartney | F24C 3/124 200/61.86 |
| 8,051,849 | B2 | 11/2011 | Albizuri | |
| 2005/0098025 | A1 * | 5/2005 | Fussell | G10H 1/46 84/737 |
| 2009/0080176 | A1 * | 3/2009 | Claprood | G01D 11/28 362/23.07 |
| 2010/0264344 | A1 * | 10/2010 | Shaffer | F24C 3/124 251/213 |
| 2010/0282237 | A1 * | 11/2010 | Atkinson | F24C 3/126 126/273 R |
| 2014/0145099 | A1 * | 5/2014 | Igarashi | G05D 16/2086 251/90 |
| 2014/0237790 | A1 * | 8/2014 | Messadek | G10H 1/32 428/34.1 |
| 2015/0346759 | A1 * | 12/2015 | Messadek | G05G 5/005 29/401.1 |
| 2018/0238550 | A1 * | 8/2018 | Ha | F24C 3/126 |
| 2020/0103119 | A1 * | 4/2020 | Kim | F24C 7/082 |
| 2021/0095859 | A1 * | 4/2021 | Park | F24C 7/082 |

* cited by examiner

APPARATUS FOR REDUCING UNDESIRED CHANGE IN COOKING APPLIANCE CONFIGURATION

BACKGROUND

The present embodiments relate to a method and apparatus for one or more guard features for controls/valves integrated into a cooking appliance.

Typical valves/controls for a cooktop surface may be inadvertently turned on/off. For example, this accidental operation may occur even for a two manual operation (e.g. push and turn) to open and/or turn controls/gas valve on, and one operation to close and/or turn the controls/gas valve off. Thus, there is a need to reduce the inadvertent operation (e.g. on, off, open, close, etc.) of a control/valve, or portions thereof.

SUMMARY

In some embodiments, a range appliance may include one or more burners, a control panel, and/or one or more valves. In various embodiments, the control panel may have one or more control knobs and one or more guard members extending outwardly away from the control panel, and wherein the one or more guard members surrounds and longitudinally overlaps at least a portion of an outer periphery of the one or more control knobs. In some embodiments, one or more valves may be in fluid communication with the one or more burners. In various embodiments, the one or more control knobs may be configured to operate the one or more valves between an open configuration and a closed configuration.

In addition, in some embodiments, the one or more guard members may include a proximal end adjacent the control panel and a distal free end spaced away from the control panel, wherein the distal free end defines an opening to access the one or more control knobs. In various embodiments, the one or more guard members may be cylindrical in shape between the proximal end and the distal free end. In some embodiments, one of the one or more guard members may surround two of the one or more control knobs, wherein the distal free end defines the opening to access the two control knobs. In various embodiments, the one or more guard members may include at least one display panel. In some embodiments, the one or more guard members may be discontinuous about the outer periphery of the one or more control knobs. In various embodiments, the control panel may be a front control panel of a range appliance.

In some embodiments, a gas range appliance may include a housing, a front control panel, and/or one or more gas valves. In various embodiments, the housing may include a cooktop surface. In some embodiments, the one or more gas burners may be positioned on the cooktop surface of the housing. In some embodiments, the front control panel on the front of the housing may have one or more control knobs and one or more guard members extending outwardly away from the front control panel. In various embodiments, the one or more guard members may surround and longitudinally overlap at least a portion of an outer periphery of the one or more control knobs to reduce unintentional contact with the one or more control knobs. In some embodiments, one or more gas valves may be in fluid communication with the one or more gas burners, the one or more control knobs may be configured to operate the one or more valves between an open configuration and a closed configuration.

In addition, in some embodiments, the one or more guard members may be cylindrical in shape and may include a proximal end adjacent the front control panel and a distal free end spaced away from the front control panel, wherein the distal free end defines an opening to access the one or more control knobs. In various embodiments, one of the one or more guard members may surround two of the one or more control knobs, wherein the distal free end defines the opening to access the two control knobs. In some embodiments, the one or more guard members may include at least one display panel corresponding to at least one of the one or more control knobs. In various embodiments, the one or more guard members may be discontinuous about the outer periphery of the one or more control knobs. In some embodiments, the one or more guard members may include one or more projecting walls, wherein each of the one or more projecting walls have opposing circumferential ends. In various embodiments, one of the one or more guard members may include a plurality of arcuate walls circumferentially spaced from each other to define a cylindrical wall surrounding the one or more control knobs. In some embodiments, the one or more control knobs may include a longitudinal extent from the front control panel, wherein the one or more guard members may extend longitudinally for a distance less than, about equal to, or greater than the longitudinal extent of the one or more control knobs.

In some embodiments, a range appliance may include a front control panel and/or one or more walls of a guard member. In various embodiments, the front control panel may be positioned below a cooktop surface having one or more control knobs projecting outwardly from the front control panel for operating one or more burners. In some embodiments, one or more walls of a guard member may project from the front control panel to both circumscribe and longitudinally extending along an outer periphery of the one or more control knobs. In various embodiments, the one or more walls may include a proximal end positioned adjacent the front control panel and an opposing distal free end extends longitudinally for a distance less than, about equal to, or greater than a longitudinal extent of the one or more control knobs away from the front control panel.

In addition, in some embodiments, the one or more burners may be one or more gas burners. In various embodiments, the one or more walls may be discontinuously circumscribing the outer periphery of the one or more control knobs. In some embodiments, one or more walls may have opposing circumferential ends with one or more spaces therebetween. In various embodiments, one or more walls of the guard member may include one of more display panels.

These and other advantages and features, which characterize the embodiments, are set forth in the claims annexed hereto and form a further part hereof. However, for a better understanding of the embodiments, and of the advantages and objectives attained through its use, reference should be made to the Drawings and to the accompanying descriptive matter, in which there is described example embodiments. This summary is merely provided to introduce a selection of concepts that are further described below in the detailed description, and is not intended to identify key or essential features of the claimed subject matter, nor is it intended to be used in limiting the scope of the claimed subject matter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
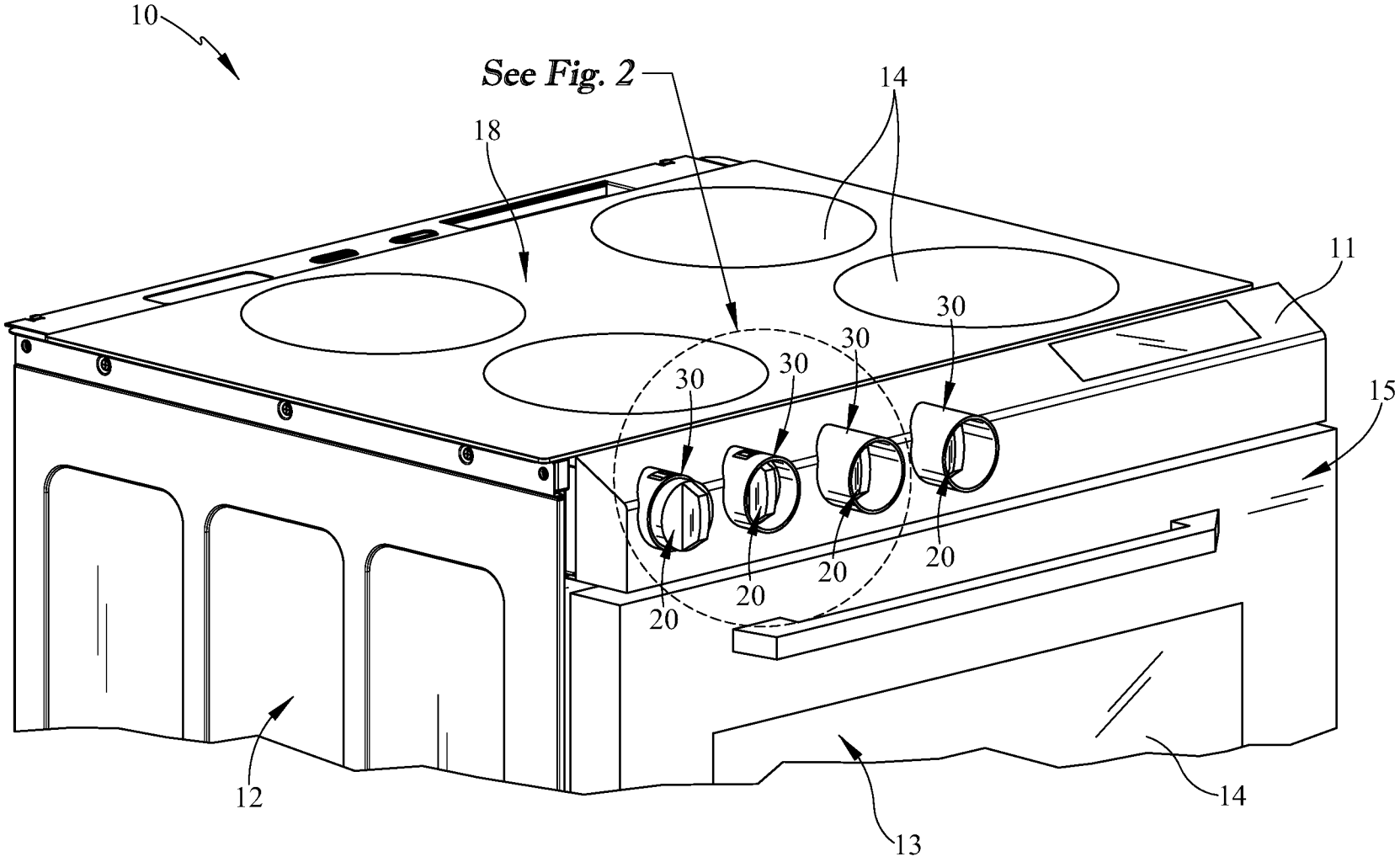
FIG. 1 is a partial perspective view of an embodiment of a cooking appliance illustrating one or more embodiments of a guard member adjacent a control knob.

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described techniques and apparatuses within a residential cooking appliance such as cooking appliance 10, such as the type that may be used in single-family or multi-family dwellings, or in other similar applications. However, it will be appreciated that the herein-described techniques and apparatuses may also be used in connection with other types of cooking appliances in some embodiments. For example, the herein-described techniques may be used in commercial applications in some embodiments. Moreover, the herein-described techniques may be used in connection with various cooking appliance configurations. Implementation of the herein-described techniques within gas/electric top burner(s), oven burner, broil burner, gas/electric range, slide-in oven, freestanding oven, gas/electric cooktop, gas/electric countertop range, etc. would be well within the abilities of one of ordinary skill in the art having the benefit of the instant disclosure, so the embodiments are not limited to the freestanding oven implementation using a manual/electronic gas valve discussed further herein. Moreover, the herein-described techniques may be used in manual and/or electronic controls/valves or other applications with controls (e.g. knobs, slides, buttons, actuators, touch screens, etc.) such as, but is not limited to, gas furnaces, gas water heaters, gas fireplaces/logs, and gas space heaters.

As shown in the Figures, one or more controls (e.g. control knobs 20) may be used within a home cooking appliance 10, such as but not limited to a freestanding cooking range, has a housing 12 and a cooking compartment 13, such as a baking oven, convection oven, steam oven, warming drawer and the like, in the housing 12 and accessible through a door or drawer. In the embodiment shown, the appliance 10 is a gas range, with the manual control knobs 20 operating one or more gas valve(s) 17, if used, in fluid communication with at least one downstream gas burner 14 (e.g. cooktop surface 18 and/or cooking compartment 13) via channels/tubes. It should be understood that the valves 17 may be electronically/mechanically/electromechanically controlled remotely from the controls/knobs in some embodiments. The gas valve 17 may engage at least one gas manifold in fluid communication with the gas, liquid, or fuel supplied to the appliance 10. The appliance 10 includes a cooktop surface 18 on a top of the housing 12. In some implementations, the manual gas valves 17 may be positioned within a control panel 11 (e.g. front control panel, rear control panel, etc.) within the cooking appliance 10 and have a plurality of control knobs or controls 20 for controlling the gas burners 14, manual gas valves 17, gas burner characteristics, and/or cooking compartment, etc. The valve may be operable between a closed configuration wherein the fuel is not in communication with the one or more burners and an open configuration wherein the fuel is in communication with the one or more burners. Although a front control panel 11 below the cooktop surface 18 on the front 15 of the housing 12 is shown in the one embodiment, it should be understood that the control panel may be of a variety of positons relative to the housing, shapes, sizes, quantities, and constructions and still be within the scope of the invention. For example, the front control panel in the one embodiment shown includes two non-parallel front surfaces facing forward away from the appliance (e.g. an inclined surface above a vertical surface).

In some implementations, one or more guard members or structures 30 may be used to reduce the accidental/unintentional contact or operation (e.g. axial and/or rotational movement) of one or more controls 20 (e.g. knobs) and/or valves 17. The one or more guard members 30 may reduce undesired contact or forces applied to the one or more control knobs 20, or portions thereof, in one or more directions that may result in operating the knob, burner 14 (e.g. electric and/or gas), and/or opening and/or closing valves 17 unintentionally. The guard members 30 may shield or block one or more portions of the exterior or portions of the control knob 20 projecting away from or outside the control panel 11. The guard member 30 and the control knob 20 extends outwardly away from the control panel. The controls or knob faces outward away from the control panel 11. The one or more guard members 30 surrounds/circumscribes and/or longitudinally overlaps an outer periphery or circumference 22 of the one or more control knobs 20, or portions thereof, in a direction away from the control panel 11. The overlapping or surrounding coverage may be a variety of surface areas, shapes, sizes, quantities, construction, and relative orientation and spacing from the outer periphery of the controls.

The one or more guard members or members 30 and/or one or more control knobs 20 may project from control panel 11 outwardly and away therefrom. The guard member 30 may include a proximal end 33 adjacent the control panel 11 and an opposing distal free end 34 spaced away from the control panel 11. The distal free end 34 may define one or more openings 35 to access the control knob 20, or portions thereof. In some embodiments, the one or more guard members 30 may be substantially circular in shape between the proximal end 33 and the distal free end 34. However, other shapes or patterns of the guard member (e.g. projecting wall or walls) are understood to be within the scope of the invention.

Figure 2:
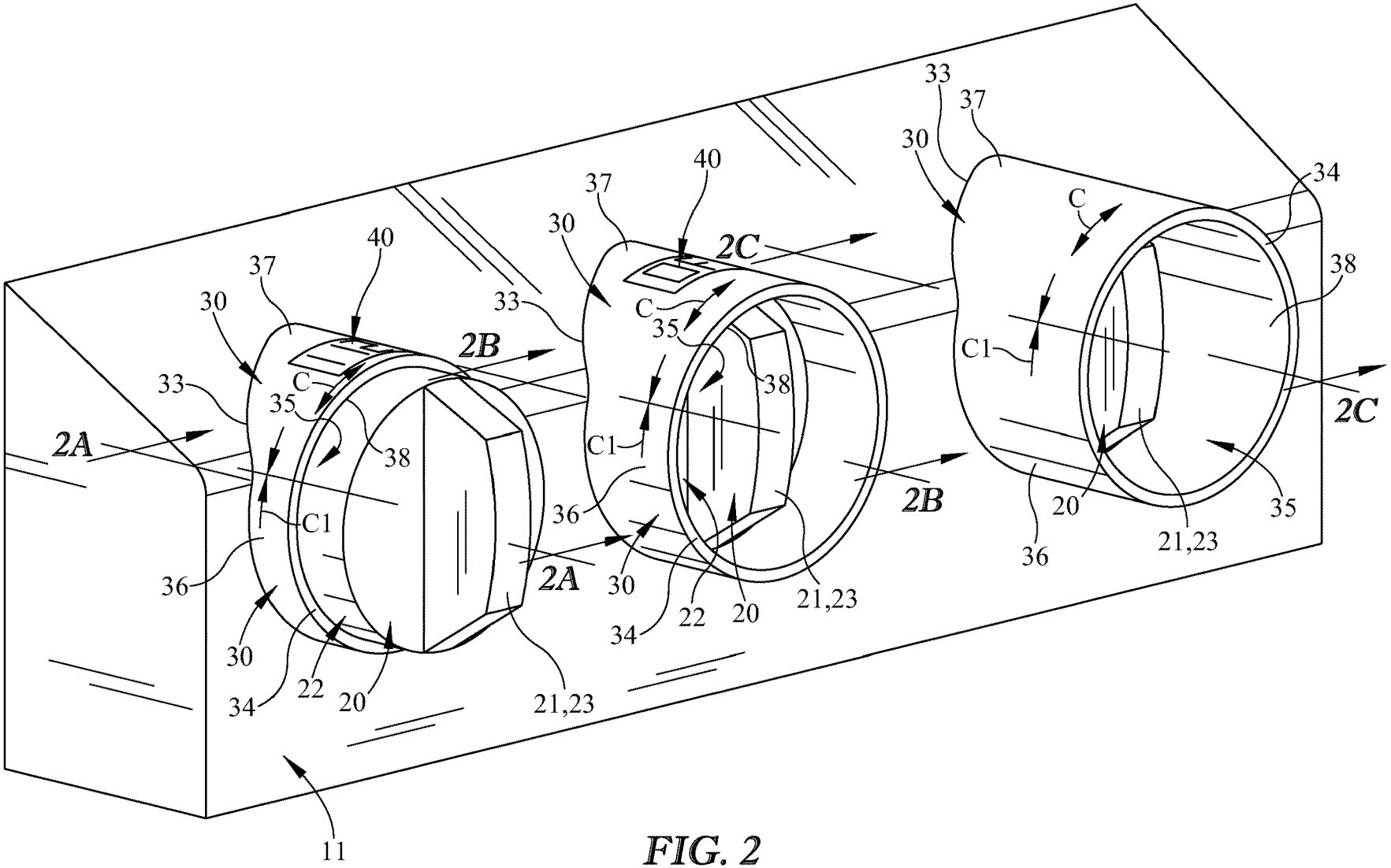
FIG. 2 is an enlarged perspective view of the guard member embodiments of FIG. 1.
Figure 2B:
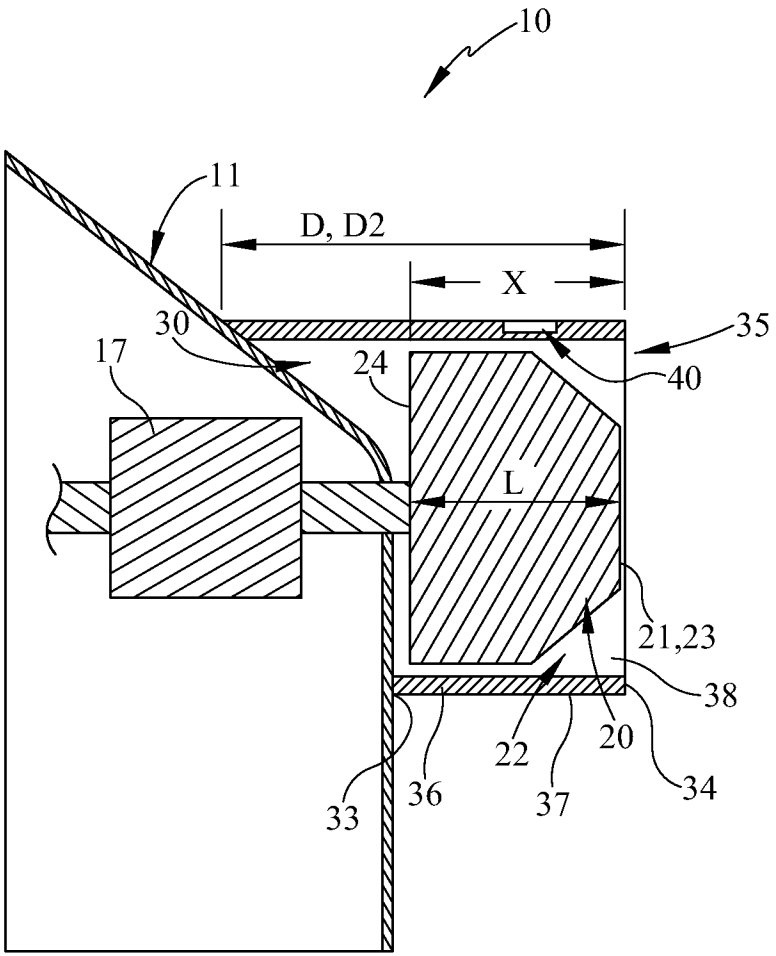
FIG. 2B is a sectional view of the embodiment of the guard member taken along line 2*b*-2*b* of FIG. 2 illustrating overlap and longitudinal length relative to the control knob.
Figure 2A:
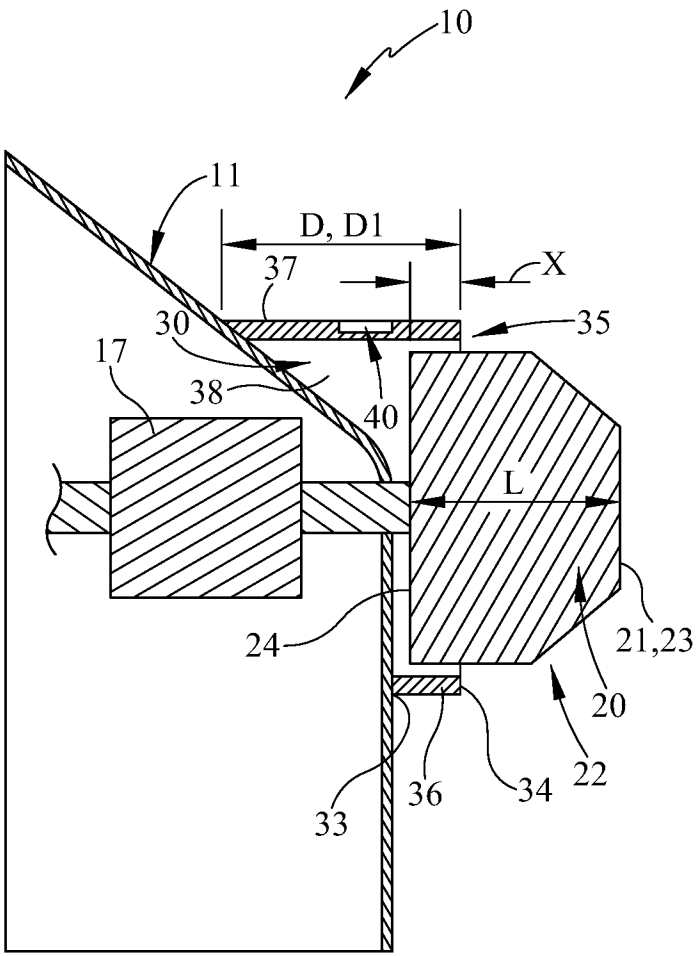
FIG. 2A is a sectional view of the embodiment of the guard member taken along line 2*a*-2*a* of FIG. 2 illustrating overlap and longitudinal length relative to the control knob.
Figure 2C:
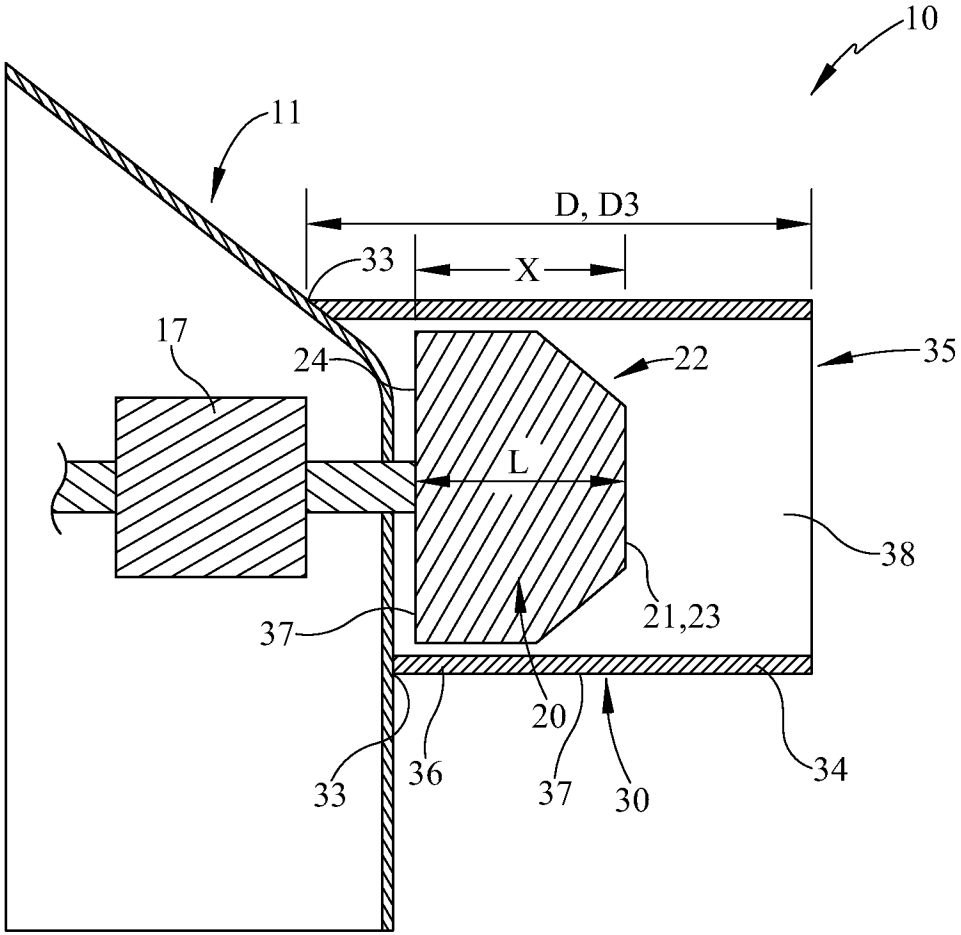
FIG. 2C is a sectional view of the embodiment of the guard member taken along line 2*c*-2*c* of FIG. 2 illustrating overlap and longitudinal length relative to the control knob.

The one or more guard members 30, or portions thereof, may surround, project, or extend outwardly for a variety of distances D from the control panel 11 (e.g. outward or front face/plane(s)). The increase in distance D may also increase the guard member's longitudinal overlap X outside of the outer periphery 22 or longitudinal length L of the control knob 20. In various embodiments, the guard member, or portions thereof, may surround the knob or controls 20 or portions thereof adjacent the proximal end 24 and/or distal end 23, and portions therebetween. For example, the guard member 30 may be positioned or overlap only the proximal end 24, or portions thereof, of the knob 20 in some embodiments. In various embodiments, the guard member 30 may be positioned or overlap both the distal end 23, or portions thereof, and the proximal end 24, or portions thereof, of the knob 20. In some implementations, as shown in the one embodiment in FIGS. 1, 2, and 2A, the one or more guard members 30 may extend for a first distance D1 that is less than the longitudinal length L, positioned short of the longitudinal extent 21 or distal end/plane 23 of the control knob 20. The outside circumference of the distal end 23 of the knob 20 may be partially exposed. The proximal end 24 is covered for a circumference C. In various embodiments, as shown in the one embodiment in FIGS. 1, 2, and 2B, the one or more guard members 30 may extend for a second distance D2 that is about equal to the longitudinal length L, positioned about flush with the longitudinal extent 21 or distal end/plane 23 of the control knob 20. The distal end 23 and the proximal end 24, and portions therebetween, are surrounded by the guard member 30 Moreover, in some embodiments, as shown in the one embodiment in FIGS. 1, 2, and 2C, the one or more guard members 30 may extend for a third distance D3 that is greater than the longitudinal length L, positioned beyond or longer than the extent 21, distal end/plane 23, and/or overlap X of the control knob 20. As the one or more distances D of the guard member, or portions thereof, increases the longitudinal overlap X with the length L of the outer periphery 22 of the control knob 20 may also increase and may subsequently extend beyond the distal free end/plane or extent/length of the control knob in some applications. Although the embodiments shown in the Figures have a variety of distances D about the periphery or circumference of the control/knob, the distance D about the circumference of the control/knob may be constant in some implementations or for a portion circumferential distances. Moreover, the distal end 34, or portions thereof, may be at different distances or may be positioned in different vertical planes.

Figure 4:
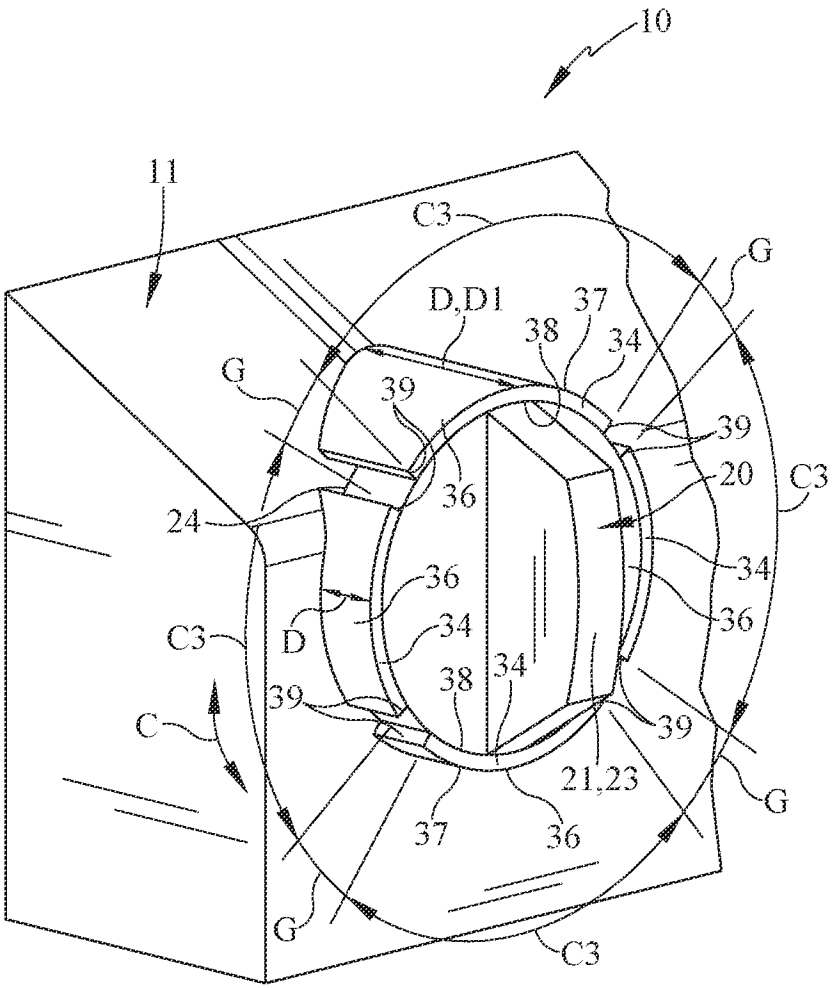
FIG. 4 is an enlarged perspective view of another embodiment of the guard member illustrating another discontinuous configuration about the control knob.
Figure 3:
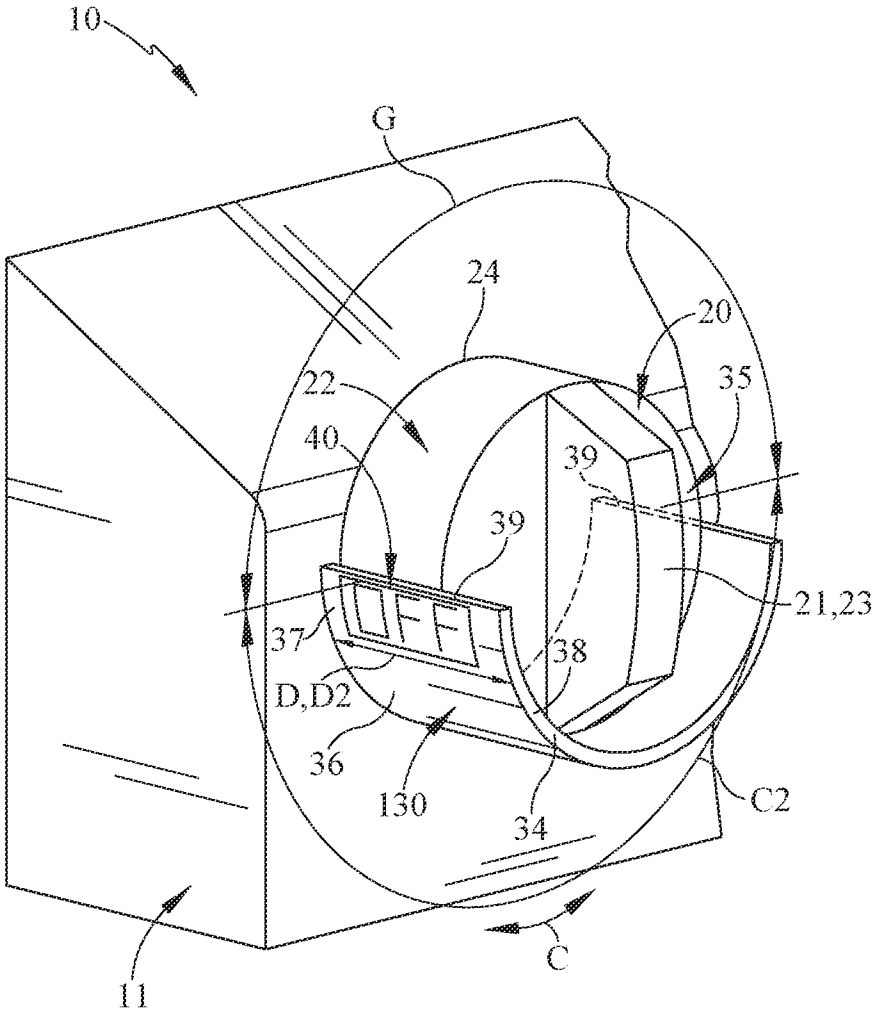
FIG. 3 is an enlarged perspective view of another embodiment of the guard member illustrating a discontinuous configuration about the control knob.
Figure 5:
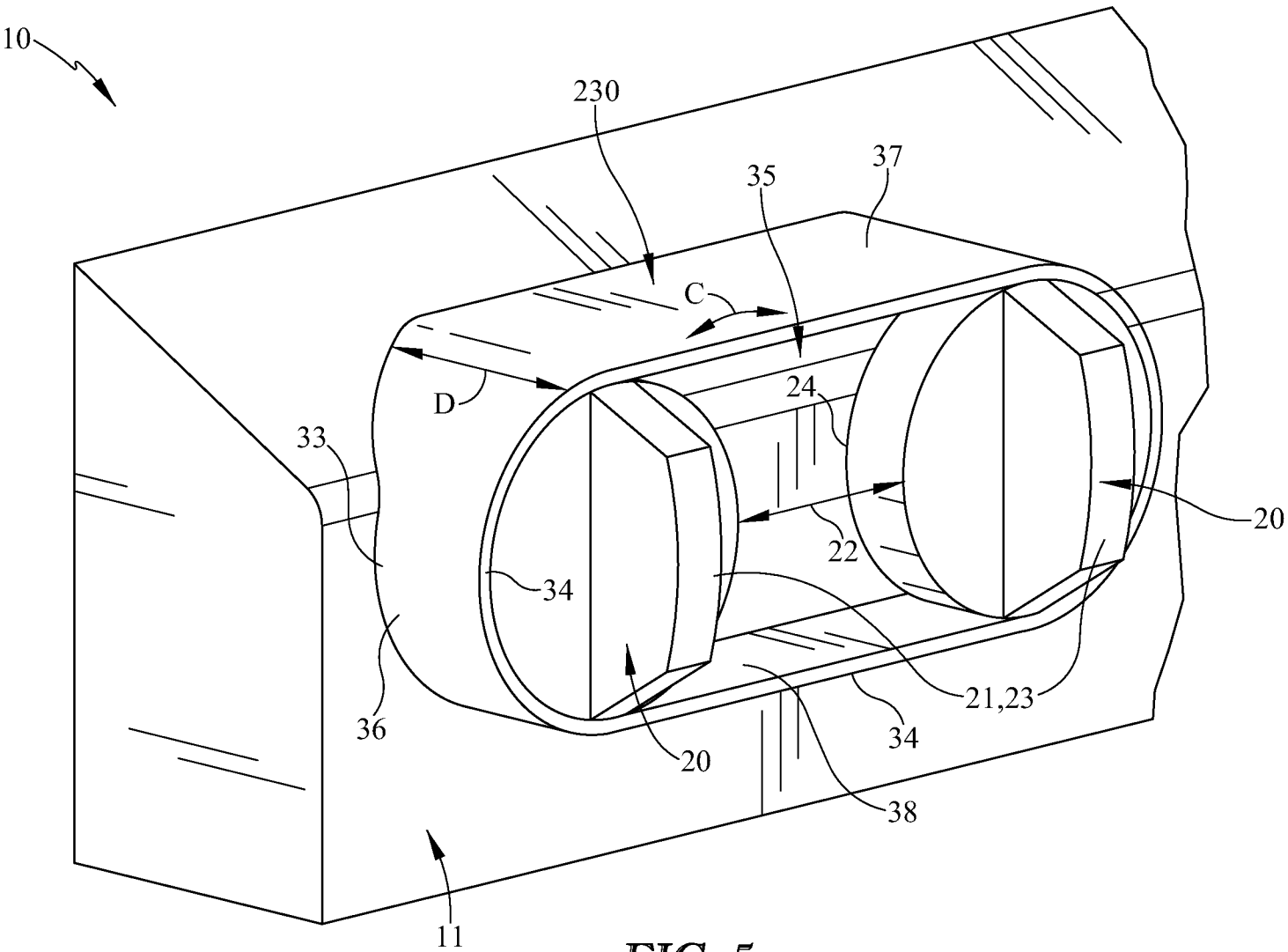
FIG. 5 is an enlarged perspective view of another embodiment of the guard member surrounding two control knobs.

The one or more guard members 30, or portions thereof, may circumscribe or surround the outer periphery of the control knob, or portions thereof, at a variety of positions, quantities, and for a variety of circumferential distances C. The one or more guard members 30 may be discontinuous or continuous about the outer periphery 22 or circumference of the one or more control knobs 20. In some embodiments as shown in FIGS. 1-2C and 5, the guard member 30 may circumscribe 360 degrees or have circumferential distance C1 about the entire control knob 20 and be continuous about the control knob outer periphery 22. In other embodiments, the guard member 30, or portions thereof, may circumscribe less than 360 degrees and greater than 0 degrees and therefore be discontinuous about the outer periphery 22 of the control knob 20. In the one embodiment shown in FIG. 3, one guard member 130 (e.g. single projecting wall 36) may have a circumferential distance C2 that is discontinuous and less than 360 degrees (e.g. about 180 degrees) and has a single space or lateral gap/opening G between the opposing circumferential ends 39. As shown positioned on the lower 180 degrees in FIG. 3, the one or more guard members 130 may be positioned on the lower half and block common movement or forces from the bottom direction upwardly towards the control knob 20 while having the upper half/circumference or gap G open for access to the user. In some embodiments, the upper half may include the one or more guard members. In the one embodiment shown in FIG. 4, two or more guard members or a plurality of guard members 30, walls 36 or portions thereof, may be discontinuous and include one or more circumferential distances C3 (e.g. same or different circumferential distance) that are spaced apart by one or more spaces or lateral gaps/openings G (e.g. same or different sizes). Although the spaces G may be shown as continuous for the distance D from the proximal end 33 to the distal free end 34, the spaces may be a variety of sizes, shapes, quantities, construction, and positions circumferentially and/or longitudinal about the control knob. For example, the space may be a lateral through opening in the guard member periphery that does not extend longitudinally through the distal free end 34, as a result the guard member may be both continuous and discontinuous about the circumference C at the various distances D along the length of the guard member in some embodiments. For example, a cylindrical body with through openings radially extending through from the inner diameter through the outer diameter. Although the embodiments shown in the Figures have a constant circumference C for each wall 36 about the periphery or circumference of the control/knob to the distal end or for distance D, the circumference C of each wall or portions of the guard member about the circumference of the control/knob may vary in some implementations. It should be understood that the circumference may be a variety of sizes, shapes, quantities, construction, and positions circumferentially and/or longitudinal about the control knob.

In some implementations, the one or more guard members 30, 130, and/or 230, or portions thereof, may include one or more display panels 40, or portions thereof. The display panel 40, as shown in the one embodiment, may be on an outer periphery 37 of the guard member, but may alternatively, or also be positioned on the inner periphery 38 of the guard member. The display panel 40, if used, may provide the user with a variety of information and/or characteristics of the appliance 10, or portions thereof. For example, the temperature of one or more burners 14 and/or there is a cooktop surface 18 with increased temperature may be displayed. The display panel may show operation status of the knob/burner/valve (e.g. on, off, etc.). The display panel may indicate burner location on the cooktop surface relative to one or more control knobs. The display panel may indicate characteristics of the oven compartment. It should be understood that the display panel, if used, may be of a variety of positions, sizes, quantities, shapes, constructions, and still display a variety of characteristics or information to the surrounding environment or user.

The one or more guard members 30 may correspond or be positioned about one or more controls (e.g. control knobs). In some implementations, as shown in FIGS. 1-4, the one or more guard members 30, 130 surround a single control knob 20. The opening 35 of the one or more guard members 30 may provide user access to the control knob 20, or portions thereof. Moreover, in the one embodiment shown in FIG. 5, the guard member 230 (e.g. one or more walls 36) may surround two or more controls (e.g. knobs) and still be within the scope of the invention. The one or more openings 35 (e.g. single race-track or oval shape) defined by the one or more guard members 230 may provide access to the two or more control knobs 20 by the user.

In some implementations, one or more guard members 30 may include one or more walls, trim, bezels, panels, or members 36 projecting from one or more surface of the control panel 11. In the one embodiment shown, the one or more walls 36 are positioned in a pattern or are circular in shape about the control knob 20. The one or more walls 36 may be positioned at substantially the same radius surrounding the knob 20. Alternatively, the one or more walls 36 may be positioned at different radius about the control knob 20 in some embodiments. The one or more walls 36 may extend to the same distance D longitudinally extending from the control panel 11 and/or have the same overlap X. Alternatively, the walls 36 may longitudinally extend to different distances D from the control panel in some embodiments, and/or overlap X differently. The distal free end 34 of one or more of the walls 36 may extend longitudinally for distance D less than, about equal to, or greater than the longitudinal extent 21 of the one or more control knobs 20. The one or more walls 36 may be equidistantly spaced from each other about control knob away from the control panel. Alternatively, the gaps G (e.g. size, length, etc.) between one or more adjacent walls 36 may be varied in some embodiments. The one or more walls may include one or more display panels, if used. The one or more walls 36 may both circumscribe and longitudinally extend along the outer periphery 22 of the one or more control knobs 20. One or more of the walls 36 may continuously or discontinuously circumscribe the control knob 20 (e.g. outer periphery) in some embodiments. As shown in the embodiments of the Figures, one or more walls 36 of the guard member 30 are arcuate in shape with the inner periphery 38 and outer periphery 37 having different radius. The arcuate walls 36 may be circumferentially spaced from each other to define a cylindrical wall surrounding the one or more control knobs.

The guard member and/or one or more guard member walls may be a variety of shapes, sizes, quantities, constructions, and positions relative to the control panel and/or control knob and still be within the scope of the invention. For example, the one or more walls may be shapes other than circular or arcuate as shown in the embodiments.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual member, system, article, material, and/or method described herein. In addition, any combination of two or more such members, systems, articles, materials, and/or methods, if such members, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of" or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A range appliance comprising:

one or more burners;

a control panel having a front surface, one or more control knobs, and one or more guard members, wherein the one or more control knobs and the one or more guard members extend outwardly away from the control panel, and wherein the one or more guard members extend directly from the front surface of the control panel to surround and longitudinally overlap only a first portion of an outer periphery of the one or more control knobs distal from the one or more burners rather than a second portion of the outer periphery proximal the one or more burners;

one or more valves in fluid communication with the one or more burners, the one or more control knobs configured to operate the one or more valves between an open configuration and a closed configuration;

wherein the one or more guard members includes a proximal end fixed to the control panel and a distal free end spaced away from the control panel adjacent a front end of the one or more control knobs, wherein the distal free end defines a front opening to access the front end of the one or more control knobs, and wherein the one or more guard members include an inner periphery and an outer periphery between the distal free end and the proximal end of the one or more guard members;

wherein the one or more guard members includes at least one display panel, wherein the at least one display panel is positioned on at least one of the outer periphery and/or the inner periphery of the one or more guard members overlapping the first portion of the outer periphery of the one or more control knobs distal from the one or more burners: and wherein the at least one display panel is positioned on the inner periphery of the one or more guard members overlapping the first portion of the outer periphery of the one or more control knobs distal from the one or more burners.

2. The range appliance of claim 1 wherein the one or more guard members is arcuate in shape between the proximal end and the distal free end.

3. The range appliance of claim 1 wherein one of the one or more guard members surrounds two of the one or more control knobs, wherein the distal free end defines the opening to access the two control knobs.

4. The range appliance of claim 1 wherein the one or more guard members is discontinuous about the outer periphery of the one or more control knobs.

5. The range appliance of claim 1 wherein the control panel is a front control panel of a range appliance.

6. A gas range appliance comprising:

a housing having a cooktop surface;

one or more gas burners positioned on the cooktop surface of the housing;

a front control panel on the front of the housing having one or more control knobs and one or more guard members extending outwardly away from the front control panel, wherein the front control panel includes an inclined front surface positioned above a vertical front surface, and wherein the one or more guard members extend directly from the vertical front surface of the front control panel to surround and longitudinally overlap only a lower half of an outer periphery of the one or more control knobs distal from the cooktop surface to reduce unintentional contact with the one or more control knobs;

one or more gas valves in fluid communication with the one or more gas burners, the one or more control knobs configured to operate the one or more valves between an open configuration and a closed configuration; wherein the one or more guard members is arcuate in shape and includes a proximal end adjacent the front control panel and a distal free end spaced away from the front control panel adjacent a front end of the one or more control knobs, wherein the distal free end defines a front opening to access the front end of the one or more control knobs;

wherein the one or more guard members includes two or more walls fixed to the front control panel overlapping the lower half of the outer periphery of the one or more control knobs, wherein two adjacent walls of the two or more walls are spaced apart by a lateral gap extending from the front control panel to the distal free end at the lower half of the outer periphery of the one or more control knobs;

wherein the one or more guard members include an inner periphery and an outer periphery between the distal free end and the proximal end of the one or more guard members; and wherein the one or more guard members includes at least one display panel corresponding to at least one of the one or more control knobs, wherein the at least one display panel is positioned on the inner periphery of the one or more guard members.

7. The gas range appliance of claim 6 wherein one of the one or more guard members surrounds two of the one or more control knobs, wherein the distal free end defines the opening to access the two control knobs.

8. The gas range appliance of claim 6 wherein the one or more control knobs includes a longitudinal extent from the front control panel, wherein the one or more guard members extends longitudinally for a distance less than, about equal to, or greater than the longitudinal extent of the one or more control knobs.

9. A range appliance comprising:

a front control panel positioned below a cooktop surface having one or more control knobs projecting outwardly from the front control panel for operating one or more burners;

two or more walls of a guard member projects from the front control panel to both circumscribe and longitudinally extending along an outer periphery of the one or more control knobs, wherein two adjacent walls of the two or more walls are spaced apart by a lateral gap;

the two or more walls includes a proximal end fixed to the front control panel and an opposing distal free end extends longitudinally for a distance less than, about equal to, or greater than a longitudinal extent of the one or more control knobs away from the front control panel;

wherein each one of the two or more walls has opposing circumferential ends defining the lateral gap therebetween, and wherein the lateral gap extends for the entire distance from the proximal end and the front control panel to the opposing distal free end of the two adjacent walls of the two or more walls;

wherein the two or more walls include an inner periphery and an outer periphery between the distal free end and the proximal end of the two or more walls; and wherein the two or more walls of the guard member include one or more display panels, wherein the one or more display panels is positioned on the inner periphery of the two or more walls.

10. The range appliance of claim 9 wherein the one or more burners is one or more gas burners.

11. The range appliance of claim 9 wherein the two or more walls are discontinuously circumscribing the outer periphery of the one or more control knobs distal from the cooktop surface.

12. The range appliance of claim 1 wherein the at least one display panel is positioned on the outer periphery of the one or more guard members overlapping the first portion of the outer periphery of the one or more control knobs distal from the one or more burners.

* * * * *